US008477949B2

(12) United States Patent
Larsen et al.

(10) Patent No.: US 8,477,949 B2
(45) Date of Patent: Jul. 2, 2013

(54) 2.1 CROSSOVER EQUALIZATION IN PC AUDIO APPLICATIONS

(75) Inventors: Christian Larsen, Irvine, CA (US); Mouna Elkhatib, Tustin, CA (US); James W Wihardja, Fullerton, CA (US); Jonathan Chien, Tustin, CA (US)

(73) Assignee: Conexant Systems, Inc., Newport Beach, CA (US)

( * ) Notice: Subject to any disclaimer, the term of this patent is extended or adjusted under 35 U.S.C. 154(b) by 774 days.

(21) Appl. No.: 12/579,200

(22) Filed: Oct. 14, 2009

(65) Prior Publication Data

US 2011/0085668 A1 Apr. 14, 2011

(51) Int. Cl.
*H04R 5/00* (2006.01)

(52) U.S. Cl.
USPC ..... 381/1; 700/94

(58) Field of Classification Search
USPC ..... 381/1, 2, 17–23, 102–104, 120, 98, 381/99, 27, 106, 300, 307; 700/94
See application file for complete search history.

(56) References Cited

U.S. PATENT DOCUMENTS

| | | | | |
|---|---|---|---|---|
| 5,195,141 | A * | 3/1993 | Jang | 381/103 |
| 5,987,145 | A | 11/1999 | Lawton | |
| 7,062,340 | B2 * | 6/2006 | Melanson | 700/94 |
| 2005/0094829 | A1 * | 5/2005 | Cordell | 381/103 |
| 2010/0067716 | A1 * | 3/2010 | Katayama | 381/99 |

OTHER PUBLICATIONS

"High Definition Audio Specification", Intel, Apr. 15, 2004, pp. iii-174, Revision 1.0, Intel Corporation, USA.

* cited by examiner

*Primary Examiner* — Lun-See Lao
(74) *Attorney, Agent, or Firm* — Jackson Walker L.L.P.; Christopher J. Rourk

(57) ABSTRACT

Challenges to the implementation of equalization in the 2.1 environment arise from the constraints imposed by HD audio requirements and Windows® Vista™. A hybrid software hardware solution overcomes many of the challenges by exploiting the software capability for equalization and using a hardware codec to perform the separation into high frequency and low frequency audio streams needed to drive stereo speakers and a subwoofer.

20 Claims, 7 Drawing Sheets

2.1 CROSSOVER EQUALIZATION IN PC AUDIO APPLICATIONS

BACKGROUND OF THE INVENTION

1. Field of the Invention

The present invention relates generally to audio applications and specifically with equalization in audio applications.

2. Related Art

A common audio configuration uses two stereo channels and a subwoofer channel, known as 2.1. The two stereo channels drive a left and a right speaker, respectively, which respond well to high frequency audio content. The subwoofer channel drives a subwoofer which is generally larger and will respond to low frequency audio content.

FIG. 1 illustrates a conventional codec that drives a 2.1 system. A digital stereo signal is separated into high and low frequency components by crossover filter 110 which comprise high pass filter 102 and low pass filter 104. High pass filter 102 extracts the high frequency portion of digital audio signal and low pass filter 104 extracts the low frequency portion of the digital audio signal. The frequency dividing the high and low frequency portions is often referred to as the "crossover" frequency. The high frequency portion of the audio signal is converted to an analog signal using digital to analog converter (DAC) 108. This analog signal can then drive speakers 122. Additional analog processing functions 114 can comprise an analog amplifier and line driver. Similarly, the low frequency portion is converted to an analog signal using DAC 112. Unlike the high frequency components which have a left and right channel. Subwoofers generally use only a monaural channel. Mono mixer 106 is used to convert the stereo signal into a monaural signal. The monaural analog audio signal can then drive subwoofer 124. Additional analog processing functions 116 may also be provided.

Although shown as single components, the connections shown in the drawings can represent multiple channels. Furthermore, many components are shown as a single block but in practice, may be implemented with multiple components. For example, a "stereo" DAC (e.g., DAC 108) may be implemented as two separate DACs one for each stereo channel.

Equalization is used to alter the frequency response of an audio system to enhance the listening experience. For example, output transducers, speakers and headphones have varied frequency responses. The defects in the frequency response of the output transducer can be compensated for by selectively attenuating or applying gain to the signal at particular frequencies. Equalizers can be implemented algorithmically, or through the use of passive or active electrical components.

Traditionally, the application of equalization to a 2.1. audio system employs a high frequency equalizer to equalize the high frequency portion of the audio signal destined for the stereo speakers and a low frequency equalizer to equalize the low frequency portion of the audio signal destined for the subwoofer.

Under Intel's High Definition Audio standard (HD-audio) commonly used in personal computers, a 2.1 channel audio stream is not specifically recognized. As a result, contemporary HD-audio implementations use a separate DAC and audio stream for the subwoofer. Software can be used to perform the crossover filtering and the equalization.

FIG. 2 illustrates an exemplary HD-audio implementation. Software module 210 separates the audio stream into two audio paths that are applied to high-pass filter 214 and low pass filter 216, respectively, which are software implementations of high pass filter 102 and low pass filter 104, respectively. High frequency equalizer 218 applies equalization to the high frequency audio path while low frequency equalizer 220 applies equalization to the low frequency audio path. Mono mixer 224 on the low frequency audio path is a software implementation of mono mixer 106. The two audio paths traverse HD-audio interface 230 to communicate with hardware codec 240. Interface 232 provides an HD-audio interface between software module 210 and hardware codec 240 for the high frequency audio path. Likewise interface 234 provides an HD-audio interface between software module 210 and hardware codec 240. Hardware codec 240 comprises DAC 242 and DAC 244 which function similarly to DAC 108 and DAC 112 as described for FIG. 1. Block 246 and block 248 are similar to that described for block 114 and block 116, respectively.

While this architecture provides a workable system for providing equalization in a 2.1 audio system, it suffers from several draw backs. First, in order to perform the separation in the software, the incoming audio stream has to be duplicated so that high pass filter 214 can filter one copy of the audio stream and low pass filter 216 can filter another copy of the audio stream. To accomplish this, copy operation 212 is performed, which causes a certain amount of latency. Because both audio streams must remain synchronous, the audio stream sent to the high frequency audio path needs to be delayed to maintain synchronicity with audio stream sent to the low frequency path, thus producing additional delay.

Another drawback to this approach is that to meet HD-audio requirements in certain operating systems, such as Microsoft Corporation's Windows® Vista™ or Windows® 7, any audio stream used by the HD-audio interface must be exposed as an audio output stream to the operating system and ultimately to the end user. In order to use a separate stream for the subwoofer and to satisfy the constraints imposed by Windows® Vista™, a subwoofer object will show up as a user-accessible output endpoint on an "audio control panel."

For example, FIG. 3 shows an exemplary "control panel" in Windows® Vista™. Object 302 is used to select the output speakers. Selection of object 302 will also select the subwoofer through a redirection in the software. In order to satisfy the HD-audio requirements of the operating system, object 304 is also displayed to direct an audio stream to the subwoofer alone. The display of object 304 is required by the HD-audio requirements, which is unnecessary because selection of object 302 will produced the desired speaker selection. With two objects available, it becomes possible for the end user to select the subwoofer as the destination of the audio stream. If this occurs the end-user would experience no high frequency sounds. In addition, if multiple 2.1 channel outputs are available to the end-user, the number of objects required to be display would increase resulting in more confusion to the end-user and increasing the probability of error by the end-user in selecting the audio playback device.

SUMMARY OF INVENTION

In a system, a 2.1 audio system has a software module including a digital full band equalizer in communications with a hardware codec. The hardware codec includes a crossover filter for separating a stereo signal into high frequency and low frequency components. The hardware codec also includes a mono mixer which combines the low frequency components of the stereo signal a monaural audio signal. The hardware codec also includes a stereo DAC for converting the high frequency components of the audio signal to an analog signal which can undergo additional analog processing such as an amplifier and/or line driver and which ultimately drives a pair of speakers. The hardware codec also includes a subwoofer DAC for converting the low frequency monaural audio signal into an analog signal which can also undergo additional analog processing and which ultimately drives a subwoofer.

In an alternate embodiment, a 2.1 audio system comprises a hardware codec which receives a stereo audio signal from an HD-audio interface. The hardware codec comprises a crossover filter and mono mixer, but also comprises a digital high frequency equalizer and a low frequency equalizer to process the high frequency and low frequency components of the received stereo signal.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

Figure 1:
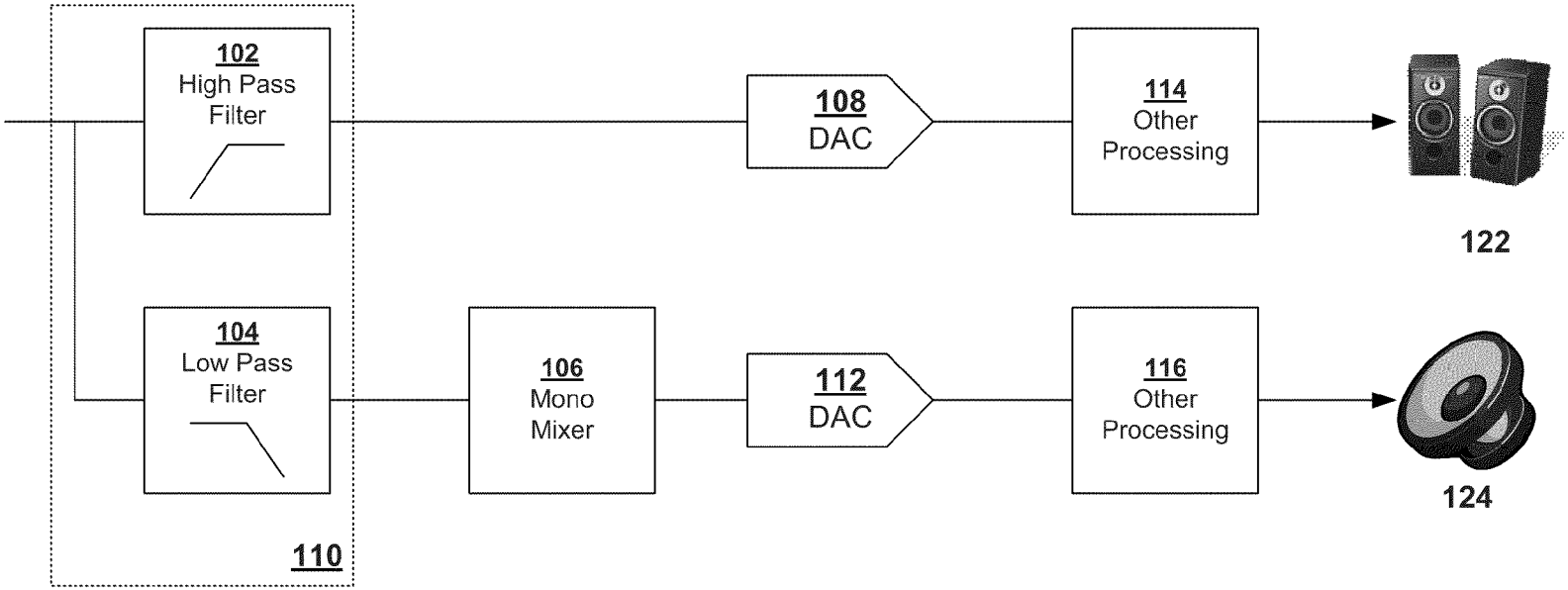
FIG. 1 (Prior Art)
FIG. 1 illustrates a conventional codec that drives a 2.1 system.
Figure 2:
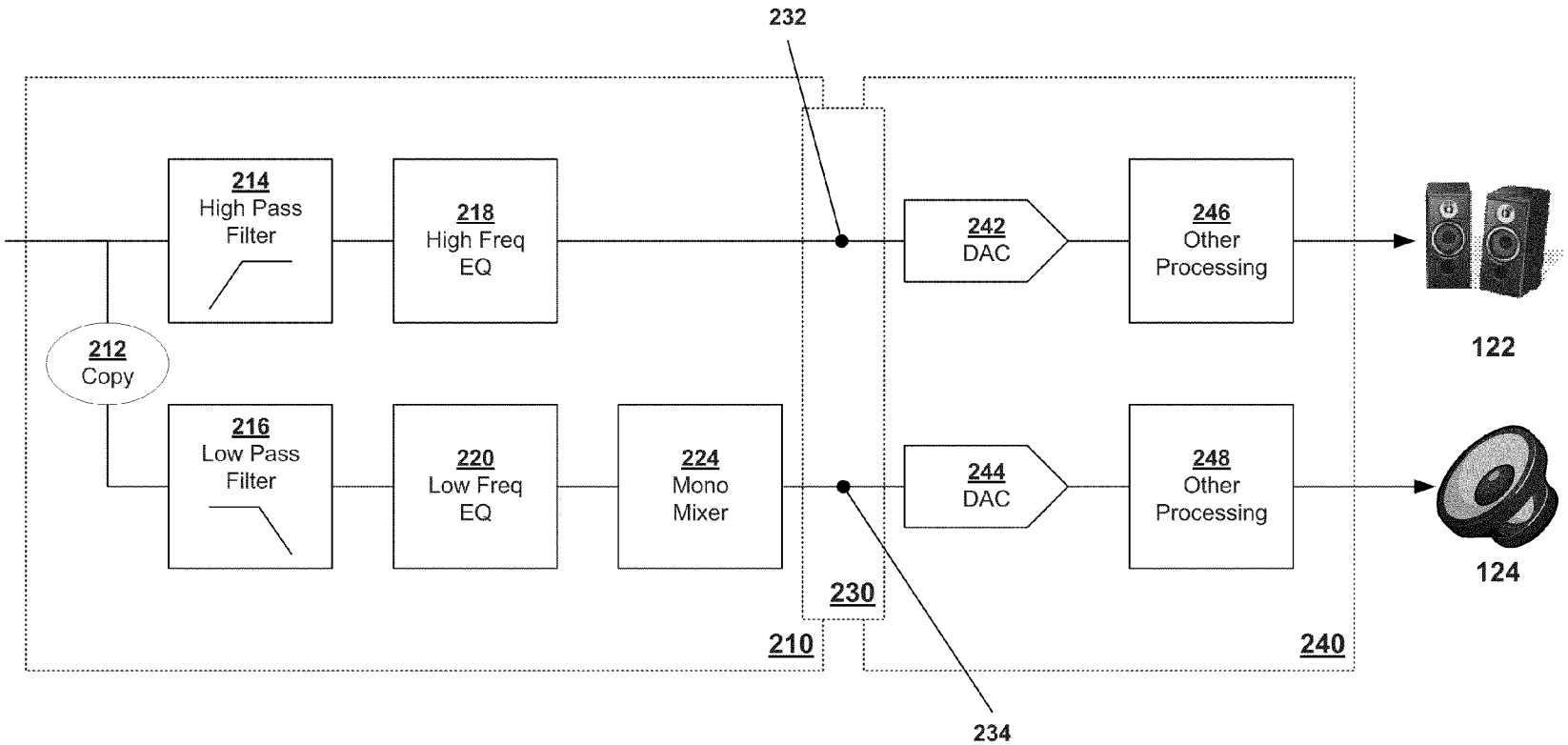
FIG. 2 (Prior Art)
FIG. 2 illustrates an exemplary HD-audio implementation of a 2.1 system.

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

A detailed description of embodiments of the present invention is presented below. While the disclosure will be described in connection with these drawings, there is no intent to limit it to the embodiment or embodiments disclosed herein. On the contrary, the intent is to cover all alternatives, modifications and equivalents included within the spirit and scope of the disclosure.

Figure 4:
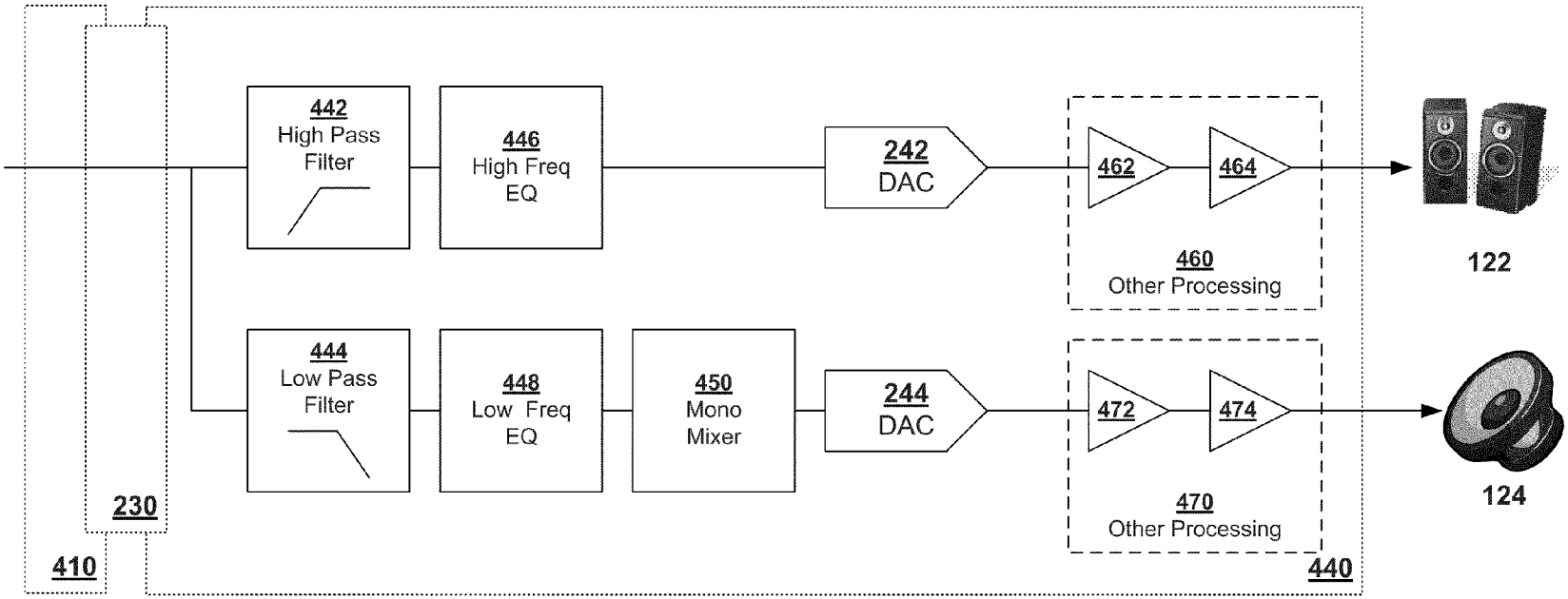
FIG. 4 illustrates an embodiment of the present invention.

It should be noted that for clarity the diagrams shown each audio stream is represented by a single line, but can comprise several channels. For example, between high pass filter 442 and high frequency equalizer 446, a single audio path is shown in FIG. 4. However, this audio path comprises a left channel and a right channel.

FIG. 4 illustrates an embodiment of a hardware solution providing equalization in a 2.1 environment. Hardware codec 440 comprises a crossover filter here shown as comprising high pass filter 442 and low pass filter 444. Hardware codec 440 further comprises high frequency equalizer 446, low frequency equalizer 448, mono mixer 450, DAC 242, DAC 244 and processing blocks 460 and 470. Processing blocks 460 and 470 perform additional analog processing. As an example processing blocks 460 and 470 each are shown as comprising amplifiers 462 and 472, respectively and line drivers 464 and 474, respectively. In this embodiment, each of the components of hardware codec 440 is implemented in hardware, without software performing any processing.

The embodiment of FIG. 4 resolves many of the drawbacks found in the prior art. As illustrated, only one audio stream is need for communication between software module 410 and hardware codec 440 through interface 230. Therefore, the operating system and the end-user are exposed to a single audio stream. In addition, because the audio stream is duplicated in hardware, the latency issue is eliminated.

In certain applications, equalization can be expensive to implement in hardware. Equalization can use substantial configuration information from an end-user manipulating a graphic equalizer interface or equalization parameters determined from speaker or headphone characteristics. A hardware equalizer that is both tunable to the number of equalization parameters and that provides good frequency response can be costly. In HD-audio environments, the HD-audio requirements can impose additional constraints on the amount of configuration information made available to the hardware codec.

Figure 5:
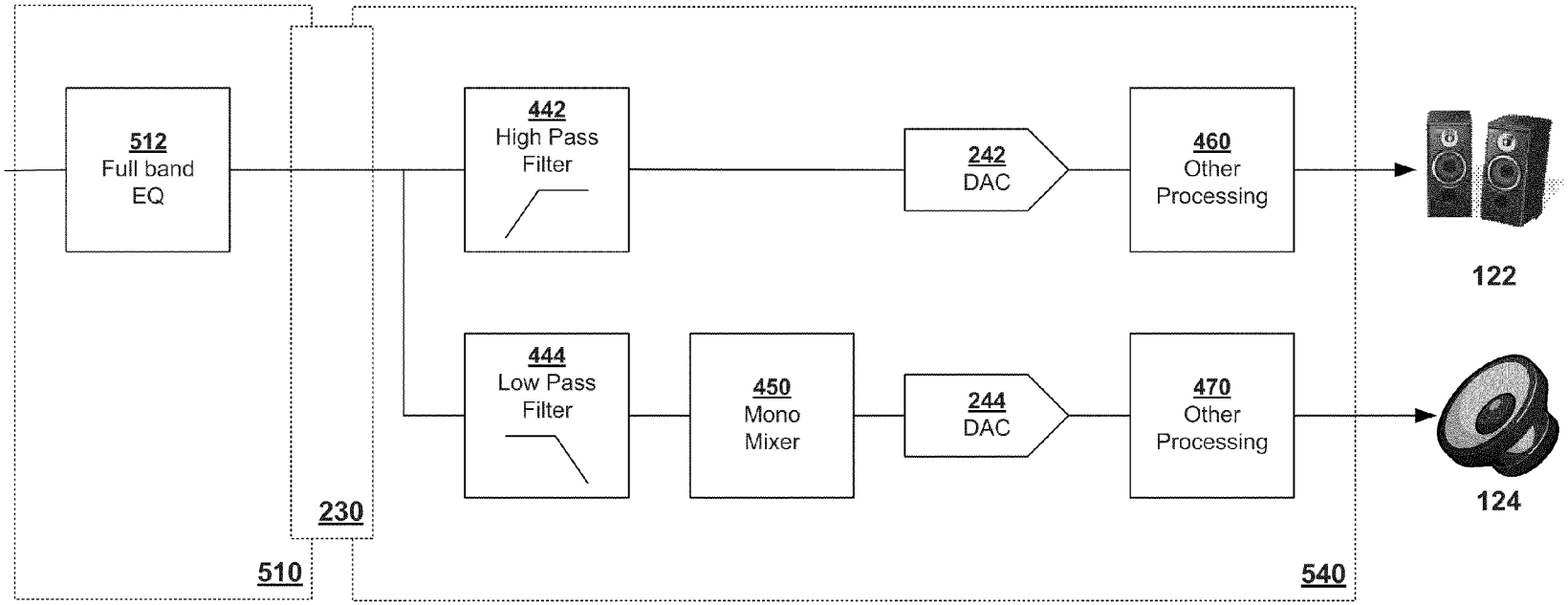
FIG. 5 illustrates an alternative embodiment of the present invention.

FIG. 5 illustrates an alternate embodiment of the present invention that includes an equalizer implemented in software. The configuration comprises software module 510 which communicates to hardware codec 540 through HD-audio interface 230. Only one interface 230 is needed to support the 2.1 audio stream. Software module 510 comprises a full band equalizer 512 that functions as a high frequency equalizer when processing high frequency audio components in an audio stream and a low frequency equalizer when processing low frequency audio components in an audio stream. In one embodiment, the two processes occur simultaneously on an input audio stream provided as a time domain signal. The equalized audio stream is passed through HD-audio interface 230 to hardware codec 540. Hardware codec 540 duplicates the stream into a high frequency audio path and a low frequency audio path. Because the duplication is done in hardware the latency problem of a software copy is eliminated. The copy of the stereo audio stream sent to the high frequency audio path is high pass filtered by high pass filter 442 and converted to a stereo analog signal with DAC 242. The stereo analog signal is then driven by block 460 to drive stereo speakers 122. The copy of the stereo audio stream sent to the low frequency audio path is low pass filtered by low pass filter 444 and the stereo audio stream is mixed into a single monaural audio signal by mono mixer 450. The resultant monaural audio stream is converted to a monaural analog signal by DAC 244 and subwoofer 124 is driven by block 470.

The embodiment of FIG. 5 has many advantages over the prior art. The HD-audio interface only uses one audio stream to communicate between the software module and the hardware codec, presenting the user with a single "2.1 speaker" endpoint, rather than a stereo speaker endpoint and a subwoofer endpoint. By moving the crossover separation to the hardware the latency problem experienced by a software stream copy is eliminated. Digital filters are implemented in hardware leaving the more complex equalization to the software module, thus reducing the cost of implementation.

Figure 3:
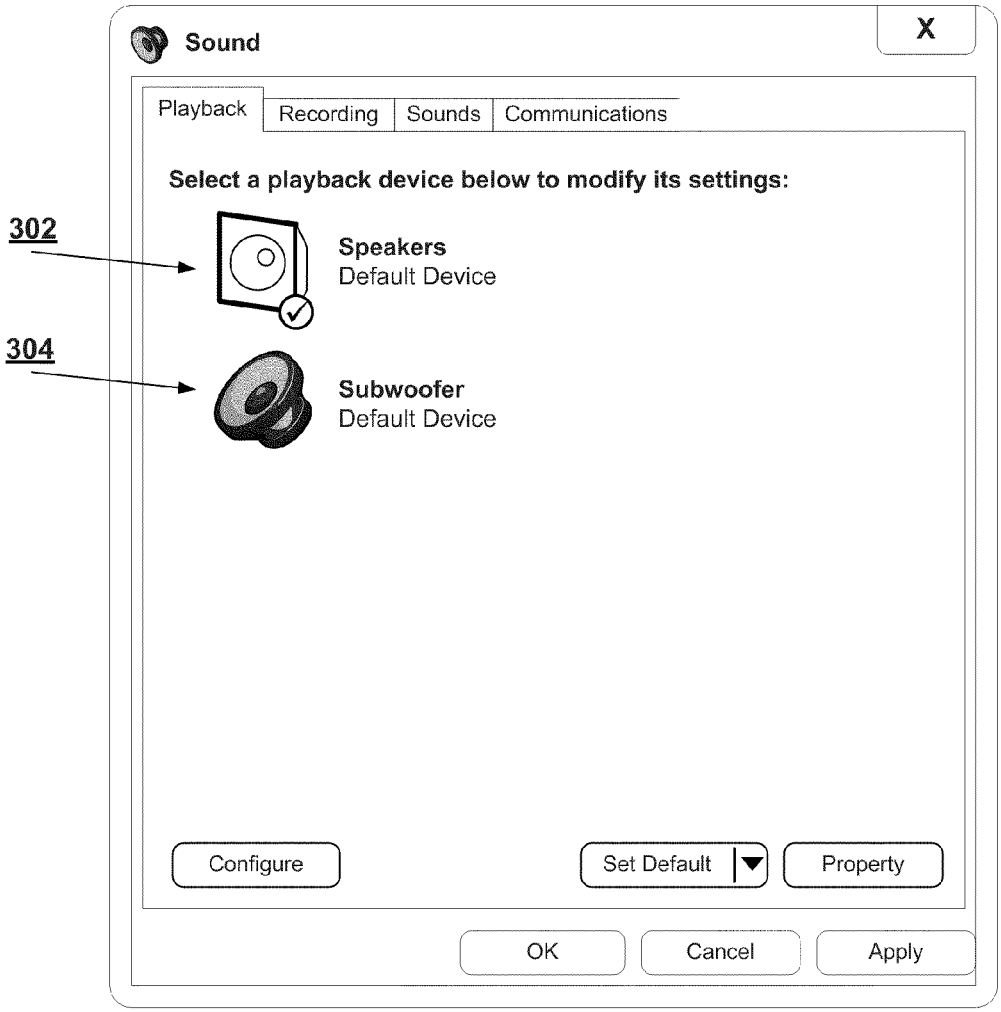
FIG. 3 (Prior Art)
FIG. 3 shows an exemplary "control panel" in Windows® Vista™.
Figure 6:
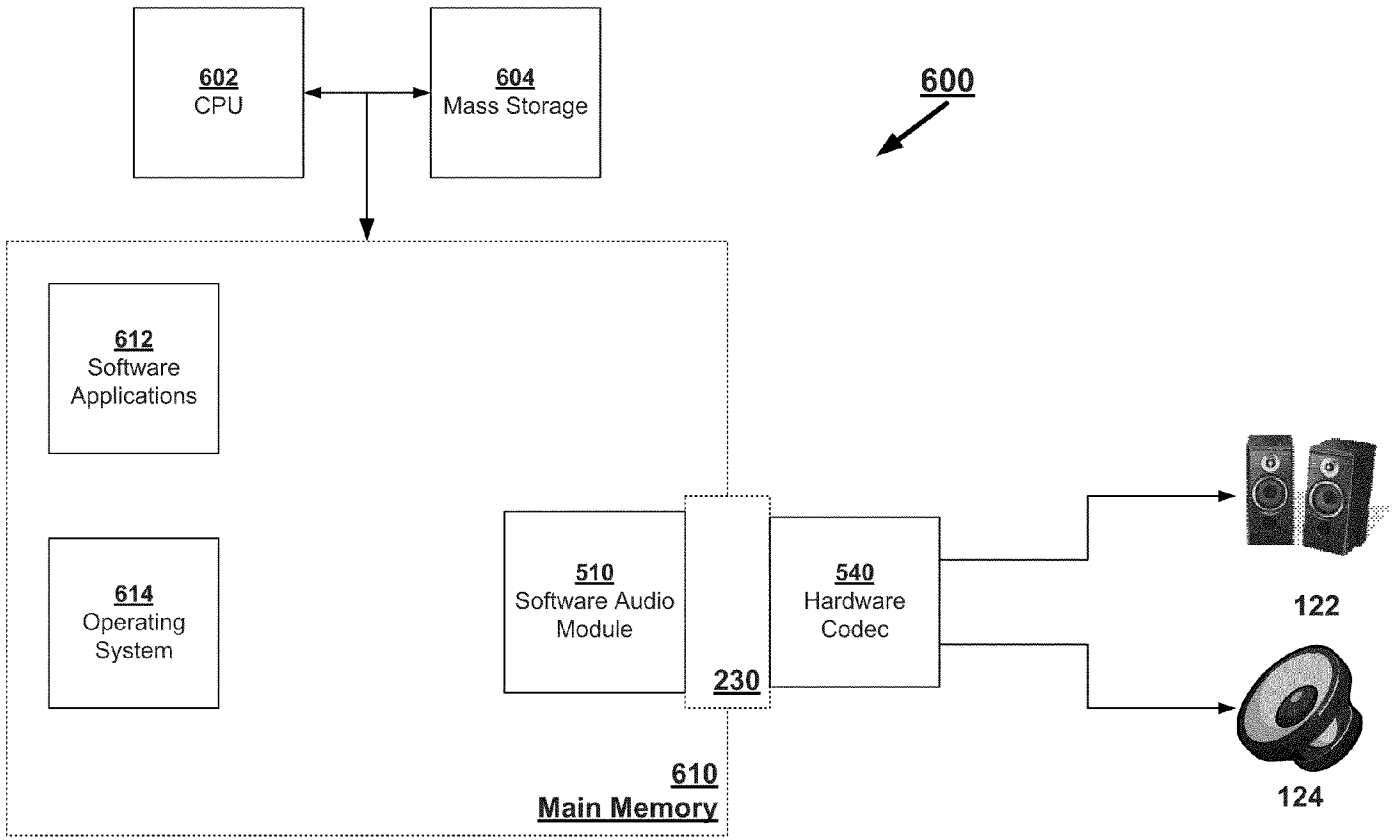
FIG. 6 shows an exemplary system employing the 2.1 audio equalization, according to one embodiment of the present invention.

FIG. 6 shows an exemplary system employing the 2.1 audio equalization, according to one embodiment of the present invention. In the embodiment of FIG. 3, system 600 includes a controller or central processing unit (CPU) 602, optionally mass storage device 604, main memory 610, and hardware audio codec 540 which was described previously in FIG. 5. System 600, which can be for example, a personal computer (PC), a laptop computer or a personal electronics device, can also include input devices, a display, read only memory (ROM), an input/output (I/O) adapter, a user interface adapter, a communications adapter, and a display adapter, which are not shown in FIG. 6. System 600 can further include a compact disk (CD), a digital video disk (DVD), and a flash memory storage device, which are also not shown in FIG. 6, as well as other computer-readable media as known in the art.

As shown in FIG. 6, CPU 602 is coupled to mass storage device 604 and main memory 610 typically through a bus which provides a communications conduit for the above devices. CPU 602 can be a microprocessor, such as a microprocessor manufactured by Advanced Micro Devices, Inc., or Intel Corporation. Mass storage device 604 can provide storage for data and applications and can comprise a hard drive or other suitable non-volatile memory device. Main memory 610 provides temporary storage for data and applications and can comprise random access memory (RAM), such as dynamic RAM (DRAM), or other suitable type of volatile memory. Also shown in FIG. 6, main memory 610 includes software applications 612, which can include client applications that employ audio, operating system 614, which can be Windows® Vista™ or Windows® 7, and software module 510 which was described previously in FIG. 5.

It should be noted that software module 510, software applications 612, and operating system 614 are shown to reside in main memory 610 to represent the fact that programs are typically loaded from slower mass storage, such as mass storage device 604, into faster main memory, such as DRAM, for execution. Software module 510 is coupled to hardware codec 540 through HD audio interface 230. The particular audio endpoint is selectable through the use of a control panel interface provided by operating system 614.

Figure 7:
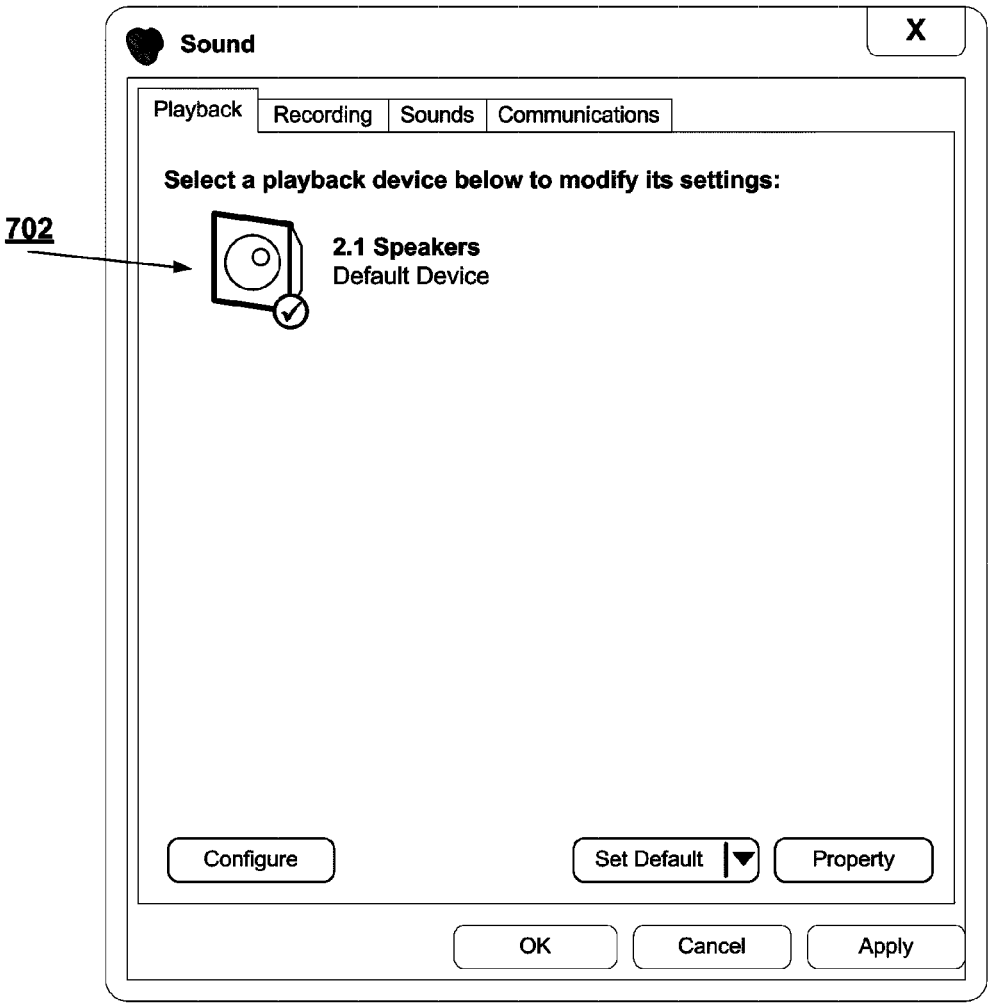
FIG. 7 shows an embodiment of the control panel interface provided by the operating system.

FIG. 7 shows an embodiment of the control panel interface provided by the operating system. Unlike the prior art control panel interface of FIG. 3, the end user is only offered 2.1 single endpoint 702 for both the two stereo speakers and the subwoofer.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed:

1. In a system having an operating system and an audio output having a pair of speakers and a subwoofer, an audio system comprising:

a central processing unit;

an operating memory coupled to the central processing unit, the operating memory allocated into the operating system and a software audio module accessing by the central processing unit;

an HD-audio interface coupled to the operating memory;

a user interface display generated by the operating system on a display device including a user-selectable 2.1 endpoint and excluding user-selectable endpoints for two stereo speakers and a subwoofer that comprise the 2.1 endpoint;

a software module in communication with the operating system, said software module comprising a digital full band equalizer; and a hardware codec operable to receive an audio stream comprising a left stereo channel and a right stereo channel from the software module through an audio interface;

wherein the hardware codec further comprises:

a crossover filter for dividing each of the left stereo channel and the right stereo channel into a high frequency audio signal and a low frequency audio signal;

a mono mixer operable to combine the low frequency audio signal from the left stereo channel and the low frequency audio signal from right stereo channel into a monaural audio signal;

a stereo digital to analog converter (DAC) operable to convert the high frequency audio signal from the left stereo channel and the high frequency audio signal from the right stereo channel into a high frequency analog stereo signal and to drive the pair of speakers with the high frequency analog stereo signal; and a subwoofer DAC operable to convert the monaural audio signal to an low frequency analog signal and to drive a subwoofer with the low frequency analog signal.

2. The system of claim 1 further comprises a stereo line driver operable to drive the speakers with the high frequency analog stereo signal.

3. The system of claim 1 further comprises a subwoofer line driver operable to drive the subwoofer with the low frequency analog signal.

4. The system of claim 1 further comprises an amplifier operable to amplify the low frequency analog signal.

5. The system of claim 1 further comprises an amplifier operable to amplify the high frequency analog stereo signal.

6. The system of claim 1 wherein the operating system is Windows® Vista™.

7. The system of claim 1 wherein the operating system is Windows® Vista 7.

8. The system of claim 1 wherein the crossover filter comprises a high pass filter operable to extract the high frequency audio signal from each channel and a low pass filter operable to extract the low frequency audio signal from each channel.

9. The system of claim 1 wherein system is a personal computer.

10. A method of providing 2.1 channel stereo sound comprising:

allocating an operating memory into an operating system and a software audio module accessing by a central processing unit;

generating a user interface on a display device that includes a user-selectable 2.1 endpoint and excludes separate user-selectable endpoints for two stereo speakers and a subwoofer that comprise the 2.1 endpoint using the operating system;

equalizing an audio stream with a software module;

providing through an HD-audio interface the audio stream from the software module to a hardware codec;

separating a high frequency audio stream and a low frequency audio stream from the audio stream;

combining a left channel signal and a right channel signal from the low frequency audio stream to create a monaural audio signal;

converting the high frequency audio stream to an analog high frequency audio stream;

converting the monaural audio stream to an analog monaural audio stream;

driving speakers with the analog high frequency audio stream; and driving a subwoofer with the analog monaural audio stream.

11. The method of claim 10 wherein the separating comprises:

extracting a high frequency audio stream from the audio stream; and extracting a low frequency audio stream from the audio stream.

12. The method of claim 10 wherein the operating system is Windows® Vista™.

13. The method of claim 10 wherein the operating system is Windows® 7.

14. In a system having an audio output having a pair of speakers and a subwoofer, an audio system comprising:

a central processing unit;

an operating memory coupled to the central processing unit, the operating memory allocated into an operating system and a software audio module accessing by the central processing unit;

an HD-audio interface coupled to the operating memory;

a user interface display generated by the operating system on a display device including a user-selectable 2.1 endpoint and excluding user-selectable endpoints for two stereo speakers and a subwoofer that comprise the 2.1 endpoint;

a hardware codec operable to receive an audio stream from the operating memory through the audio HD-audio interface said audio stream comprising a left stereo channel and a right stereo channel;

wherein the hardware codec further comprises:

a crossover filter for dividing each of the left stereo channel and the right stereo channel into a high frequency audio signal and a low frequency audio signal;

a high frequency equalizer operable to equalize the high frequency audio signal;

a low frequency equalizer operable to equalize the low frequency audio signal;

a mono mixer operable to combine the low frequency audio signal from the left stereo channel and the low frequency audio signal from right stereo channel into a monaural audio signal;

a stereo DAC operable to convert the high frequency audio signal from the left stereo channel and the high frequency audio signal from the right stereo channel into a high frequency analog stereo signal and to drive the pair of speakers with the high frequency analog stereo signal; and a subwoofer DAC operable to convert the monaural audio signal to an low frequency analog signal and to drive a subwoofer with the low frequency analog signal.

15. The system of claim 14 further comprises a stereo line driver operable to drive the speakers with the high frequency analog stereo signal.

16. The system of claim 14 further comprises a subwoofer line driver operable to drive the subwoofer with the low frequency analog signal.

17. The system of claim 14 further comprises an amplifier operable to amplify the low frequency analog signal.

18. The system of claim 14 further comprises an amplifier operable to amplify the high frequency analog stereo signal.

19. The system of claim 14 wherein the crossover filter comprises a high pass filter operable to extract the high frequency audio signal from each channel and a low pass filter operable to extract the low frequency audio signal from each channel.

20. The system of claim 14 wherein system is a personal computer.

* * * * *